US011976365B1

(12) United States Patent
Ahmed et al.

(10) Patent No.: US 11,976,365 B1
(45) Date of Patent: May 7, 2024

(54) METHOD OF FORMING METAL OXIDE NANOSTRUCTURES ON A TiN-BUFFERED-SUBSTRATE

(71) Applicant: King Faisal University, Al-Ahsa (SA)

(72) Inventors: Faheem Ahmed, Al-Ahsa (SA); Nishat Arshi, Al-Ahsa (SA); Shalendra Kumar, Al-Ahsa (SA); Nagih Mohammed Shaalan, Al-Ahsa (SA); Ghazzai Almutairi, Al-Ahsa (SA); P. M. Z. Hasan, Al-Ahsa (SA); Naushad Ahmad, Al-Ahsa (SA); Thamraa Alshahrani, Al-Ahsa (SA); Afzal Hussain, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/122,396

(22) Filed: Mar. 16, 2023

(51) Int. Cl.
*C23C 18/12* (2006.01)

(52) U.S. Cl.
CPC ..... *C23C 18/1216* (2013.01); *C23C 18/1245* (2013.01); *C23C 18/1266* (2013.01); *C23C 18/1291* (2013.01)

(58) Field of Classification Search
CPC ..... C23C 18/1216; C23C 18/1245; C23C 18/1266; C23C 18/1291
See application file for complete search history.

(56) References Cited

U.S. PATENT DOCUMENTS

2005/0009224 A1* 1/2005 Yang ..... H01L 21/02628 438/57
2010/0180950 A1* 7/2010 Gao ..... H01L 33/20 257/E21.47
2011/0033974 A1* 2/2011 Wang ..... H01L 21/02606 977/890
2011/0290003 A1* 12/2011 Liu ..... C30B 29/16 977/773
2021/0226115 A1* 7/2021 Wang ..... H01L 31/1884

FOREIGN PATENT DOCUMENTS

KR 20110024038 A 3/2011
KR 101738573 B1 5/2017
WO 2010048623 A2 4/2010

OTHER PUBLICATIONS

Lin et al "Buffer-Facilitated Epitaxial Growth of ZnO Nanowire" Crystal Growth & Design, vol. 5, No. 2, 2005 p. 579-583. (Year: 2005).*

(Continued)

*Primary Examiner* — Nathan H Empie
(74) *Attorney, Agent, or Firm* — Nath, Goldberg & Meyer; Richard C. Litman

(57) ABSTRACT

A method of forming one-dimensional metal oxide nanostructures includes forming a TiN film on a substrate to provide a TiN-coated substrate; providing an aqueous mixture including hexamethylenetetramine and a metal nitrate, contacting the TiN-coated substrate with the aqueous mixture such that the TiN film on the substrate is in the aqueous mixture, and heating the aqueous mixture at a temperature ranging from about 50° C. to about 100° C. for a period of time ranging from about 60 minutes to about 180 minutes to form the metal oxide nanostructures. The method offers a low-temperature approach for the growth of metal oxide (Continued)

nanostructures. In an embodiment, the metal oxide is zinc oxide (ZnO) and the metal nitrate is zinc nitrate. In an embodiment the substrate is a $Si/SiO_2$ substrate. In an embodiment, the metal oxide nanostructures include one-dimensional nanostructures, such as nanorods.

6 Claims, 2 Drawing Sheets

(56) References Cited

OTHER PUBLICATIONS

Syed et al "Controlled Hydrothermal growth of vertically-aligned zinc oxide nanowires using silicon and polyimide substrates" Microelectronic Engineering 145 (2015) 86-90. (Year: 2015).*
Lin et al "Buffer-Facilitated Epitaxial Growth of ZnO nanowire" Crystal Growth & Design, vol. 5, No. 2 2005. (Year: 2005).*
Syed et al. "Controlled hydrothermal growth of vertically-aligned zinc oxide nanowire using silicon and polyimide substrates" Microelectronic Engineering 145 (2015) 86-90. (Year: 2015).*
Yeh et al "Fabrication and characterization of ZnO nanorods on polished titanium substrate using electrochemical-hydrothermal methods" Thin Solid films 544 (2013) 521-525. (Year: 2013).*
Jin et al., "Low-Temperature Solution-Based Growth of ZnO Nanorods and Thin Films on Si Substrates" Journal of Nanoscience and Nanotechnology 9 (12):7432-5, Dec. 2009.
Gao et al., "ZnO nanorods/plates on Si substrate grown by low-temperature hydrothermal reaction," Applied Surface Science, 256(9):2781-2785, Feb. 2010.
Zhao et al., "Buffer layer effect on ZnO nanorods growth alignment," Chemical Physics Letters 408(4-6):335-338, Jun. 2005.
Hou et al., "The chemical precipitation synthesis of nanorose-shaped Bi40512 with highly visible light photocatalytic performance," Materials Letters, vol. 252, pp. 106-109, Oct. 2019.

* cited by examiner

METHOD OF FORMING METAL OXIDE NANOSTRUCTURES ON A TiN-BUFFERED-SUBSTRATE

BACKGROUND

1. Field

The disclosure of the present patent application relates to a method of forming metal oxide nanostructures, and particularly, to a method of growing metal oxide nanostructures on a TiN-buffered substrate.

2. Description of the Related Art

Due to their promising applications in electronic and optoelectronic devices, the development of novel synthetic methodologies for one-dimensional (1D) metal oxide nanostructures and particularly, ZnO nanostructures, has attracted enormous attention. Generally, high-temperature vapor-phase processes are conventionally used for forming such metal oxide nanostructures. These conventional methods, however, are typically costly and require high-energy consumption.

Thus, a low-temperature, more cost- and energy-effective method of forming metal oxide nanostructures solving the aforementioned problems is desired.

SUMMARY

The present subject matter relates to a low-temperature method of forming one-dimensional (1D) metal oxide nanostructures.

In one embodiment, the present subject matter relates to a method of forming one-dimensional metal oxide nanostructures comprising forming a TiN film on a substrate to provide a TiN-coated substrate; providing an aqueous mixture including hexamethylenetetramine and a metal nitrate, contacting the TiN-coated substrate with the aqueous mixture such that the TiN film on the substrate is in the aqueous mixture, and heating the aqueous mixture at a temperature ranging from about 50° C. to about 100° C. for a period of time to form the metal oxide nanostructures. The method offers a low-temperature approach for the growth of metal oxide nanostructures.

In an embodiment, the metal oxide is zinc oxide (ZnO) and the metal nitrate is zinc nitrate. In another embodiment, the metal oxide is formed on the TiN-coated substrate over a period of time ranging from about 60 minutes to about 180 minutes. In an embodiment, the nanostructures are vertically aligned; that is, the metal oxide nanostructures are formed vertically on the TiN-coated substrate. In an embodiment, the metal oxide nanostructures include one dimensional nanostructures, such as nanorods.

In another embodiment, the substrate is a $Si/SiO_2$ substrate. In an embodiment, the TiN film is formed on the substrate by evaporating Ti metal in an $N_2$ atmosphere. In some instances of this embodiment, the substrate is placed above Ti vapor formed by evaporating the Ti metal.

These and other features of the present subject matter will become readily apparent upon further review of the following specification and drawings.

BRIEF DESCRIPTION OF THE DRAWINGS

(FIG. 2B) 50 kx magnification; and (FIG. 2C) 100 kx magnification.

Similar reference characters denote corresponding features consistently throughout the attached drawings.

DETAILED DESCRIPTION OF THE PREFERRED EMBODIMENTS

Figure 1:
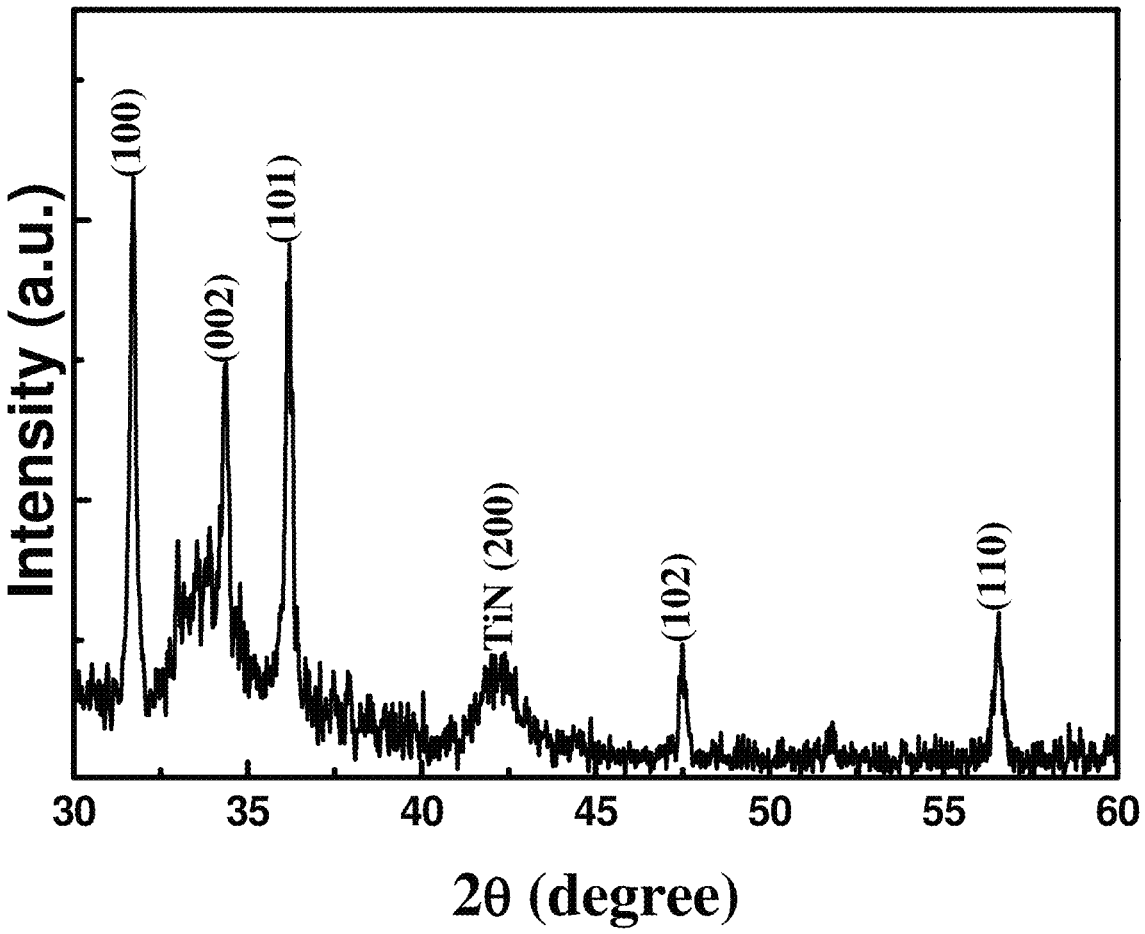
FIG. 1 is an X-ray diffraction (XRD) pattern of ZnO nanorods grown vertically on a buffer layer of TiN that has been deposited on a silicon substrate.

The following definitions are provided for the purpose of understanding the present subject matter and for construing the appended patent claims.

Definitions

It should be understood that the drawings described above or below are for illustration purposes only. The drawings are not necessarily to scale, with emphasis generally being placed upon illustrating the principles of the present teachings. The drawings are not intended to limit the scope of the present teachings in any way.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

Unless defined otherwise, all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Throughout the application, descriptions of various embodiments use "comprising" language. However, it will be understood by one of skill in the art, that in some specific instances, an embodiment can alternatively be described using the language "consisting essentially of" or "consisting of".

In one embodiment, the present subject matter relates to a method of forming metal oxide nanostructures including forming a titanium nitride (TiN) film on a substrate to provide a TiN-coated or TiN buffered-substrate; providing an aqueous mixture including hexamethylenetetramine and a metal nitrate; contacting the TiN-coated substrate with the aqueous mixture such that the TiN film on the substrate is in the aqueous mixture; and heating the aqueous mixture with the TiN film therein at a temperature ranging from about 50° C. to about 100° C. for a period of time to form the metal oxide nanostructures. In an embodiment, the period of time that the aqueous mixture is heated ranges from about 60 minutes to about 180 minutes. In an embodiment, the metal oxide nanostructures are zinc oxide (ZnO) nanostructures and the metal nitrate is zinc nitrate. In an embodiment the substrate is a silicon (Si) substrate, e.g., a $Si/SiO_2$ substrate. In an embodiment, the ZnO nanostructures are vertically aligned; that is, the metal oxide nanostructures are formed vertically on the TiN-coated substrate. In an embodiment, the ZnO nanostructures include ZnO nanorods ranging from about 1 μm to about 2 μm in length and/or from about 30 nm to about 80 nm in diameter.

In an embodiment, the $Si/SiO_2$ substrate is prepared by oxidizing an Si substrate in a furnace for about one to two hours at temperatures ranging from about 1000° C. to about 1200° C. and cleaning the oxidized substrate by rinsing in ultrasonic baths of acetone and methanol.

In an embodiment, the TiN film can be formed on the substrate using electron beam evaporation. By way of non-limiting example, once suitably prepared the oxidized Si substrate can then be fixed in a single-rotation holder to allow the process to continue. In one embodiment in this regard, the oxidized Si substrate can be mounted about 300 mm above the vapor source. Ti metal can then be evaporated from a vapor source in 100% $N_2$ atmosphere to form a TiN film on a $Si/SiO_2$ substrate fixed above the vapor surface. In an embodiment, the vapor source can include commercial Ti metal slugs which are placed into a crucible to provide evaporation sources for film deposition.

In an embodiment, the TiN film can enhance vertical growth of ZnO nanostructures on the Si substrate. In an embodiment, the metal oxide nanostructures are zinc oxide nanostructures. In an embodiment, the aqueous mixture can include from about 0.011 M to about 0.055 M zinc nitrate and from about 0.011 M to about 0.055 M hexamethylenetetramine. In an embodiment, about 0.011 M to about 0.055 M zinc nitrate is added to an aqueous solution including from about 0.011 M to about 0.055 M hexamethylenetetramine and vigorously stirred while heating to temperatures ranging from about 50° C. to about 100° C. According to this embodiment, the substrate is maintained at temperatures ranging from about 50° C. to about 100° C. for about 60 minutes to about 180 minutes to allow the ZnO nanostructures to be grown thereon. The ZnO nanostructures can be thoroughly washed with deionized water and air-dried at temperatures ranging from about 80° C. to about 90° C. for about 12 hours to about 24 hours.

The ZnO nanorods can be formed while heating the TiN-coated Si substrate in the aqueous mixture at temperatures ranging from about 50° C. to about 100° C., for example, temperatures ranging from about 60° C. to about 95° C. Accordingly, with the present method, ZnO nanostructures can be formed at temperatures that are much lower than temperatures typically required to form ZnO nanostructures. In addition, using the present methods, the ZnO nanostructures can be formed in a period of time ranging from about 60 minutes to about 180 minutes. Thus, the present methods for forming nanostructures are much faster than conventionally used methods. The ZnO nanostructures can be useful for electronic and optoelectronic devices. It should be understood that the present method can be useful for large-scale production ZnO nanostructures as well as other metal oxide nanostructures.

The present teachings are illustrated by the following examples.

Example 1

TiN Deposition

TiN films were deposited onto $Si/SiO_2$ (100) substrates by evaporating Ti metal in 100% $N_2$ atmosphere in a vacuum chamber. The Si (100) substrates (area=40 mm×20 mm) were oxidized in a furnace for 1-2 hours at 1000° C.-1200° C., cleaned by rinsing in ultrasonic baths of acetone and methanol and then fixed in a single-rotation holder mounted 300 mm above the vapor source. Commercial Ti metal (99.9999%; 3.2 mm diameter×3.2 mm length, purchased from Alfa Aesar) slugs were placed into a crucible as evaporation sources for film deposition. The vacuum chamber was equipped with a turbo-molecular pump, horizontally fixed to the chamber, and backed by a rotary pump, which could produce an ultimate vacuum of $2.1\times10^{-6}$-$7.2\times10^{-7}$ Torr. After achieving the ultimate vacuum, nitrogen gas with a flow rate of 0, 4, 6, 8, and 10 sccm was introduced in the chamber in order to obtain different TiN films. The total pressure of the background gas increased from $2.1\times10^{-6}$ Torr to $3.7\times10^{-3}$ Torr. A series of TiN films were deposited on the silicon substrates at various nitrogen flow rates for 5 to 60 minutes to obtain TiN-coated substrates with different nitride compositions.

Example 2

Growth of ZnO nanorods

The TiN-coated $Si/SiO_2$ substrates were used for growth of ZnO nanorods. In this step, the substrate was immersed upside down in an aqueous mixture. The aqueous mixture was formed by adding zinc nitrate (0.011 M-0.055 M) to an aqueous solution of hexamethylenetetramine (0.011 M-0.055 M) and heating to 50-100° C. while stirring vigorously. Growth of the ZnO nanorods took place at 50-100° C. for 60-180 min. Finally, the as-prepared ZnO nanorods were thoroughly washed with deionized water, and dried in air at 80-90° C. for 12-24 h before characterization.

FIG. 1 shows the X-ray diffraction (XRD) pattern of the ZnO nanorods grown vertically on a buffer layer of TiN deposited on Si substrate. The characteristic peaks of ZnO can be clearly seen in the XRD pattern which are well matched with the standard data JCPDS (36-1451) of ZnO with hexagonal wurtzite structure. Generally, ZnO crystallizes into particle shapes producing (101) peak as the high intensity as compared to other peaks due to the orientation of the particles in this direction. However, the higher intensity of (002) peaks which corresponds to the c-axis of ZnO reveals that the growth of ZnO nanorods are vertical along the c-axis. In addition to ZnO, the peak at a diffraction angle of −42 degree corresponds to the plane (200) of TiN which can be indexed to the cubic crystal structure, in accordance with the standard card (JCPDS card No: 38-1420).

Figures 2A, 2B, 2C:
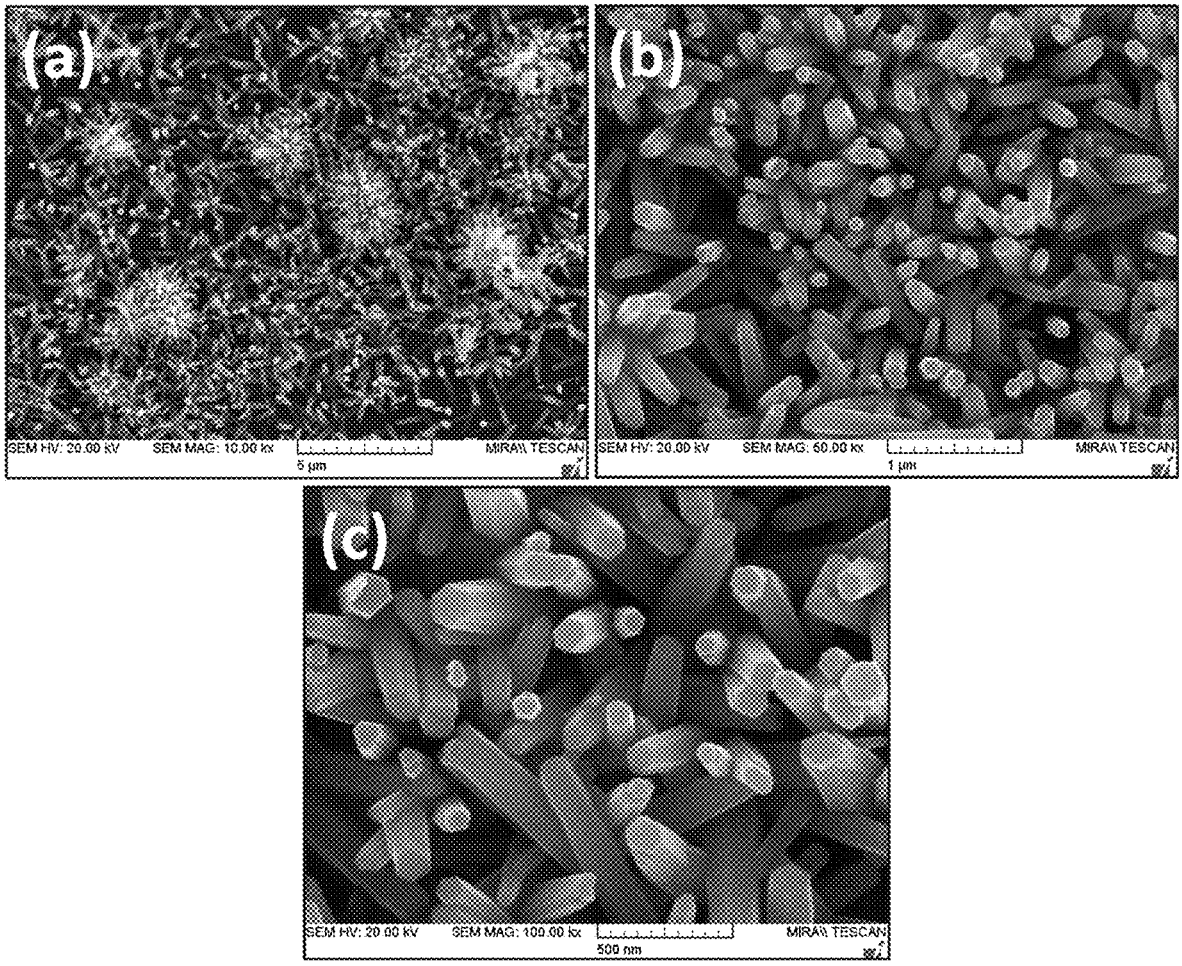
FIGS. 2A-2C are Field emission scanning electron microscopy (FE-SEM) images showing the morphology of the ZnO nanorods with (FIG. 2A) 10 kx magnification.

FIGS. 2A-2C are Field emission scanning electron microscopy (FE-SEM) images showing the morphology of the ZnO nanorods with different magnifications. From these figures, it can be seen that the ZnO nanorods have a length of 1-2 μm and a diameter of 30-80 nm. Further, the nanorods are densely packed and are aligned along the vertical direction (c-axis), while some of the nanorods are grown at different angles. A clear hexagon face is visible at the tip of the nanorods, which shows that the nanorods are grown with highly crystalline nature.

It is to be understood that the method of forming metal oxide nanostructures on a TiN-buffered substrate is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A method of forming zinc oxide nanostructures, consisting of:

forming a TiN film on a $Si/SiO_2$ silicon substrate to provide a TiN-coated substrate;

providing an aqueous mixture including hexamethylenetetramine and zinc nitrate;

contacting the TiN-coated substrate with the aqueous mixture such that the TiN film on the silicon substrate is in the aqueous mixture; and heating the aqueous mixture at a temperature ranging from about 50° C. to about 100° C. for a period of time to form the zinc oxide nano structures.

2. The method according to claim 1, wherein the zinc oxide nanostructures include zinc oxide nanorods.

3. The method according to claim 2, wherein the zinc oxide nanorods have a length ranging from about 1 μm to about 2 μm.

4. The method according to claim 2, wherein the zinc oxide nanorods have a diameter ranging from about 30 nm to about 80 nm.

5. The method according to claim 1, wherein the temperature ranges from about 60° C. to about 95° C.

6. The method according to claim 1, wherein the period of time ranges from about 60 minutes to about 180 minutes.

* * * * *